US010535306B2

(12) United States Patent
Yang et al.

(10) Patent No.: US 10,535,306 B2
(45) Date of Patent: Jan. 14, 2020

(54) PIXEL CIRCUIT, DISPLAY PANEL, DISPLAY DEVICE AND DRIVING METHOD

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN); Wenqing Zhao, Beijing (CN); Yafeng Yang, Beijing (CN); Lei Wang, Beijing (CN); Dongni Liu, Beijing (CN); Li Xiao, Beijing (CN); Pengcheng Lu, Beijing (CN); Han Yue, Beijing (CN); Jie Fu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 82 days.

(21) Appl. No.: 15/562,673

(22) PCT Filed: Mar. 24, 2017

(86) PCT No.: PCT/CN2017/077982
§ 371 (c)(1),
(2) Date: Sep. 28, 2017

(87) PCT Pub. No.: WO2018/028209
PCT Pub. Date: Feb. 15, 2018

(65) Prior Publication Data

US 2018/0357961 A1 Dec. 13, 2018

(30) Foreign Application Priority Data

Aug. 12, 2016 (CN) ..... 201610663613.2

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); (Continued)

(58) Field of Classification Search
CPC ..... G09G 3/32–3291; G09G 2320/043; G09G 2320/045
See application file for complete search history.

(56) References Cited

U.S. PATENT DOCUMENTS 8,717,272 B2 * 5/2014 Kim ..... G09G 3/2003 345/39
9,483,979 B2 11/2016 Yang
(Continued)

FOREIGN PATENT DOCUMENTS

CN 1677470 A 10/2005
CN 1737894 A 2/2006
(Continued)

OTHER PUBLICATIONS

Search Report and Written Opinion dated Jun. 21, 2017 from State Intellectual Property Office of the P.R. China.
(Continued)

*Primary Examiner* — Gene W Lee
(74) *Attorney, Agent, or Firm* — Dilworth & Baresse, LLP.; Michael J. Mussella, Esq.

(57) ABSTRACT

A pixel circuit, a display panel, a display device and a driving method are disclosed. The pixel circuit includes: a light-emitting circuit including a plurality of light-emitting sub-circuits (111); and a compensation driving circuit including an output terminal and a driving transistor. The
(Continued)

plurality of light-emitting sub-circuits are all electrically connected to the output terminal; and the compensation driving circuit is configured to receive a light-emitting data signal, compensate for a threshold voltage of the driving transistor, and drive any one of the plurality of light-emitting sub-circuits to emit light according to an output signal output by the output terminal.

2 Claims, 6 Drawing Sheets

(52) U.S. Cl.
CPC ..... *G09G 2300/043* (2013.01); *G09G 2310/0235* (2013.01); *G09G 2310/0251* (2013.01); *G09G 2320/0233* (2013.01)

(56) References Cited

U.S. PATENT DOCUMENTS

| | | | | |
|---|---|---|---|---|
| 2005/0259095 | A1 | 11/2005 | Kwak | |
| 2006/0022909 | A1 | 2/2006 | Kwak et al. | |
| 2006/0076550 | A1 | 4/2006 | Kwak et al. | |
| 2006/0113551 | A1 | 6/2006 | Kwak | |
| 2010/0283776 | A1 | 11/2010 | Park et al. | |
| 2011/0157262 | A1 | 6/2011 | Fujiwara et al. | |
| 2013/0063040 | A1 | 3/2013 | Huang et al. | |
| 2015/0002501 | A1 | 1/2015 | Choo et al. | |
| 2015/0287360 | A1 | 10/2015 | Yin et al. | |
| 2016/0253953 | A1 | 9/2016 | Yang et al. | |
| 2016/0293083 | A1* | 10/2016 | Yang | G09G 3/3233 |
| 2017/0018223 | A1* | 1/2017 | Li | G09G 3/2003 |
| 2017/0154576 | A1* | 6/2017 | Sun | G09G 3/2074 |
| 2017/0229056 | A1 | 8/2017 | Li et al. | |
| 2017/0263186 | A1 | 9/2017 | Wang et al. | |
| 2018/0137817 | A1* | 5/2018 | Wu | G09G 3/3258 |

FOREIGN PATENT DOCUMENTS

| | | | | | |
|---|---|---|---|---|---|
| CN | 1779763 | A | | 5/2006 | |
| CN | 1790466 | A | | 6/2006 | |
| CN | 1801298 | A | | 7/2006 | |
| CN | 102203847 | A | | 9/2011 | |
| CN | 102930818 | A | | 2/2013 | |
| CN | 103000127 | A | | 3/2013 | |
| CN | 103000134 | A | | 3/2013 | |
| CN | 103500556 | A | | 1/2014 | |
| CN | 104036726 | A | | 9/2014 | |
| CN | 104252833 | A | | 12/2014 | |
| CN | 104269429 | A | * | 1/2015 | G09G 3/32 |
| CN | 105243986 | A | | 1/2016 | |
| CN | 105528997 | A | | 4/2016 | |
| CN | 106448566 | A | | 2/2017 | |
| CN | 107170408 | A | | 9/2017 | |
| KR | 1020150141368 | A | | 12/2015 | |

OTHER PUBLICATIONS

Search Report and Written Opinion dated Mar. 15, 2019 from State Intellectual Property Office of the P.R. China.
Chinese Office Action dated Sep. 9, 2019.

* cited by examiner

PIXEL CIRCUIT, DISPLAY PANEL, DISPLAY DEVICE AND DRIVING METHOD

TECHNICAL FIELD

Embodiments of the present disclosure relate to a pixel circuit, a display panel, a display device and a driving method.

BACKGROUND

In the field of display technology, organic light-emitting diode (OLED) display panels have vast potential for future development because of their characteristics such as self-luminescence, higher contrast ratio, lower power consumption, wider viewing angle, quicker response, applicability in flexible panels, extensive range of operation temperatures, simple manufacturing process, etc.

In view of the foregoing characteristics, OLED display panels may be applied in devices with displaying function such as mobile phones, displays, notebook computers, digital cameras, instruments and the like.

SUMMARY

An embodiment of the present disclosure provides a pixel circuit, including: a light-emitting circuit incluidng a plurality of light-emitting sub-circuits; and a compensation driving circuit including an output terminal and a driving transistor. The plurality of light-emitting sub-circuits are all electrically connected to the output terminal; the compensation driving circuit is configured to receive a light-emitting data signal, compensate for a threshold voltage of the driving transistor, and drive any one of the plurality of light-emitting sub-circuits to emit light according to an output signal output by the output terminal.

For example, the pixel circuit provided by the embodiments of the present disclosure further includes a selection circuit. The selection circuit is electrically connected to the output terminal; the plurality of light-emitting sub-circuits are electrically connected to the selection circuit, respectively; and the compensation driving circuit is configured to drive any one of the plurality of light-emitting sub-circuits to emit light through the selection circuit.

For example, in the pixel circuit provided by an embodiment of the present disclosure, each of the light-emitting sub-circuits in the light-emitting circuit includes a switch element and a light-emitting element which are connected in series.

For example, in the pixel circuit provided by an embodiment of the present disclosure, the switch element includes a transistor, and the light-emitting element includes an organic light-emitting diode (OLED).

For example, in the pixel circuit provided by an embodiment of the present disclosure, the light-emitting circuit includes a first light-emitting sub-circuit, a second light-emitting sub-circuit and a third light-emitting sub-circuit. The first light-emitting sub-circuit includes a first switch transistor and a first OLED which are connected in series; the second light-emitting sub-circuit includes a second switch transistor and a second OLED which are connected in series; and the third light-emitting sub-circuit includes a third switch transistor and a third OLED which are connected in series.

For example, in the pixel circuit provided by an embodiment of the present disclosure, a first electrode of the first switch transistor, a first electrode of the second switch transistor, and a first electrode of the third switch transistor are electrically connected to a first node; a gate electrode of the first switch transistor is configurd to receive a first gate signal, a gate electrode of the second switch transistor is configurd to receive a second gate signal, and a gate electrode of the third switch transistor is configurd to receive a third gate signal; a second electrode of the first switch transistor is electrically connected to a first electrode of the first OLED, a second electrode of the second switch transistor is electrically connected to a first electrode of the second OLED, and a second electrode of the third switch transistor is electrically connected to a first electrode of the third OLED; and a second electrode of the first OLED, a second electrode of the second OLED and a second electrode of the third OLED are all grounded.

For example, in the pixel circuit provided by an embodiment of the present disclosure, the compensation driving circuit further includes: a first compensation transistor configured to supply the driving transistor with a first power supply voltage in response to a second scanning signal; a second compensation transistor configured to supply the driving transistor with the light-emitting data signal in response to a first scanning signal; a third compensation transistor configured to supply the driving transistor with a second power supply voltage in response to a controlling signal; a fourth compensation transistor configured to connect a gate electrode and a second electrode of the driving transistor in response to the first scanning signal; a fifth compensation transistor configured to connect the second electrode of the driving transistor and the light-emitting circuit in response to the second scanning signal; and a storage capacitor configured to store a voltage difference between a first electrode and a second electrode of the third compensation transistor.

For example, in the pixel circuit provided by an embodiment of the present disclosure, a first electrode of the first compensation transistor is configured to receive the first power supply voltage; a gate electrode of the first compensation transistor and a gate electrode of the fifth compensation transistor are configured to receive the second scanning siginal; a second electrode of the first compensation transistor is electrically connected to a second node; a first electrode of the second compensation transistor is configured to receive the light-emitting data signal; a gate electrode of the second compensation transistor and a gate electrode of the fourth compensation transistor are configured to receive the first scanning siginal; a second electrode of the second compensation transistor is electrically connected to the second node; the first electrode of the third compensation transistor is configured to receive the second power supply voltage; a gate electrode of the third compensation transistor is configured to receive the controlling siginal; the second electrode of the third compensation transistor is electrically connected to a third node; a first electrode of the fourth compensation transistor is electrically connected to the third node; a second electrode of the fourth compensation transistor is electrically connected to a fourth node; a first electrode of the fifth compensation transistor is electrically connected to the fourth node; a second electrode of the fifth compensation transistor is electrically connected to the first node; a first electrode of the driving transistor is electrically connected to the second node; the gate electrode of the driving transistor is electrically connected to the third node; the second electrode of the driving transistor is electrically connected to the fourth node; a first end of the storage capacitor is configured to receive the second power supply voltage; and a second end of the storage capacitor is electrically connected to the third node.

For example, in the pixel circuit provided by an embodiment of the present disclosure, each of the first switch transistor, the second switch transistor, the third switch transistor, the first compensation transistor, the second compensation transistor, the third compensation transistor, the fourth compensation transistor, and the fifth compensation transistor is a P-type transistor.

For example, in the pixel circuit provided by an embodiment of the present disclosure, each of the first switch transistor, the second switch transistor, the third switch transistor, the first compensation transistor, the second compensation transistor, the third compensation transistor, the fourth compensation transistor, and the fifth compensation transistor is a thin film transistor (TFT).

An embodiment of the present disclosure further provides a display panel, including the pixel circuit provided by any embodiment of the present disclosure.

For example, the pixel panel provided by an embodiment of the present disclosure further includes a scanning driver, a data driver, a light-emitting data signal line, a first gate signal line, a second gate signal line and a third gate signal line. The data driver is configured to supply the pixel circuit with the light-emitting data signal through the light-emitting data signal line; and the scanning driver is configured to supply the pixel circuit with a first gate signal, a second gate signal and a third gate signal through the first gate signal line, the second gate signal line and the third gate signal line, respectively.

An embodiment of the present disclosure further provides a display device, including the pixel panel provided by any embodiment of the present disclosure.

An embodiment of the present disclosure further provides a driving method of the pixel circuit provided by any embodiment of the present disclosure. The driving method includes: in a time period of a single frame including a plurality of time intervals, driving one of the plurality of light-emitting sub-circuits in each of the time intervals.

An embodiment of the present disclosure further provides a driving method of the pixel circuit provided by any embodiment of the present disclosure. The driving method includes: a single frame time including a first time interval, a second time interval and a third time interval. The first time interval includes a first reset time interval, a first compensation time interval and a first light-emitting time interval; the second time interval includes a second reset time interval, a second compensation time interval and a second light-emitting time interval; the third time interval includes a third reset time interval, a third compensation time interval and a third light-emitting time interval; in the first light-emitting time interval, driving the first OLED to emit light; in the second light-emitting time interval, driving the second OLED to emit light; and in the third light-emitting time interval, driving the third OLED to emit light.

For example, in the driving method provided by an embodiment of the present disclosure, the first time interval further includes a first preparing time interval prior to the first reset time interval; the second time interval further includes a second preparing time interval prior to the second reset time interval; and the third time interval further includes a third preparing time interval prior to the third reset time interval.

For example, the driving method provided by an embodiment of the present disclosure comprises, in the first preparing time interval, setting the controlling signal to be a turn-off voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage; in the first reset time interval, setting the controlling signal to be a turn-on voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage; in the first compensation time interval, setting the controlling signal to be a turn-off voltage, setting the first scanning signal to be a turn-on voltage, setting the second scanning signal to be a turn-off voltage, setting the first gate signal to be a turn-off voltage, setting the second gate signal to be a turn-off voltage, and setting the third gate signal to be a turn-off voltage; in the first light-emitting time interval, setting the controlling signal to be a turn-off voltage, setting the first scanning signal to be a turn-off voltage, setting the second scanning signal to be a turn-on voltage, setting the first gate signal to be a turn-on voltage, setting the second gate signal to be a turn-off voltage, and setting the third gate signal to be a turn-off voltage; in the second preparing time interval, setting the controlling signal to be a turn-off voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage; in the second reset time interval, setting the controlling signal to be a turn-on voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage; in the second compensation time interval, setting the controlling signal to be a turn-off voltage, setting the first scanning signal to be a turn-on voltage, setting the second scanning signal to be a turn-off voltage, setting the first gate signal to be a turn-off voltage, setting the second gate signal to be a turn-off voltage, and setting the third gate signal to be a turn-off voltage; in the second light-emitting time interval, setting the controlling signal to be a turn-off voltage, setting the first scanning signal to be a turn-off voltage, setting the second scanning signal to be a turn-on voltage, setting the first gate signal to be a turn-off voltage, setting the second gate signal to be a turn-on voltage, and setting the third gate signal to be a turn-off voltage; in the third preparing time interval, setting the controlling signal to be a turn-off voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage; in the third reset time interval, setting the controlling signal to be a turn-on voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage; in the third compensation time interval, setting the controlling signal to be a turn-off voltage, setting the first scanning signal to be a turn-on voltage, setting the second scanning signal to be a turn-off voltage, setting the first gate signal to be a turn-off voltage, setting the second gate signal to be a turn-off voltage, and setting the third gate signal to be a turn-off voltage; and in the third light-emitting time interval, setting the controlling signal to be a turn-off voltage, setting the first scanning signal to be a turn-off voltage, setting the second scanning signal to be a turn-on voltage, setting the first gate signal to be a turn-off voltage, setting the second gate signal to be a turn-off voltage, and setting the third gate signal to be a turn-on voltage.

BRIEF DESCRIPTION OF THE DRAWINGS

Hereinafter, the embodiments of the present disclosure will be described in a more detailed way with reference to the accompanying drawings, so as to make one person skilled in the art be able to understand the present disclosure more clearly, wherein.

DETAILED DESCRIPTION

Hereinafter, the technical solutions in the embodiments of the present disclosure will be described in a clearly and fully understandable way in connection with the drawings in the embodiments of the present disclosure. It is obvious that the described embodiments are just a part but not all of the embodiments of the disclosure. Based on the described embodiments herein, one person skilled in the art can obtain other embodiment(s), without any inventive work, which should be within the scope of the disclosure.

Unless otherwise defined, the technical terminology or scientific terminology used herein should have the same meaning as commonly understood by one of ordinary skill in the art to which this invention belongs. Likewise, terms like "first," "second," etc., which are used in the description and the claims of the present application for invention, are not intended to indicate any sequence, amount or importance, but distinguish various components. In addition, in the embodiments of the present disclosure, the same or similar reference numbers refer to the same or similar components.

In recent years, with the appearance of consumer electronics such as augmented reality and virtual reality, people have increasingly urgent requirements on display panels with higher resolutions, for improving user's viewing experience.

The resolution of the OLED display panel is mainly restricted by the process level of the photolithographic technology and the size of the fine metal mask (FFM). Under the circumstance that both the process level of the photolithographic technology and the manufacturing level of the FFM have been developed to a certain degree, it may be difficult for the resolution of the OLED display panel to be further improved. Therefore, it has to seek for other solutions to satisfy the requirements on higher resolution.

Figure 7A:
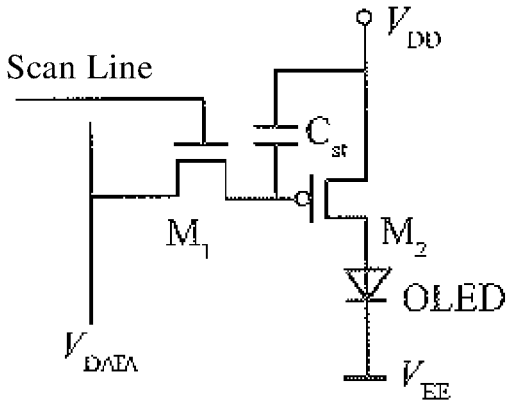
FIG. 7(*a*) and FIG. 7(*b*) respectively illustrate a 2T1C pixel circuit.
Figure 7B:
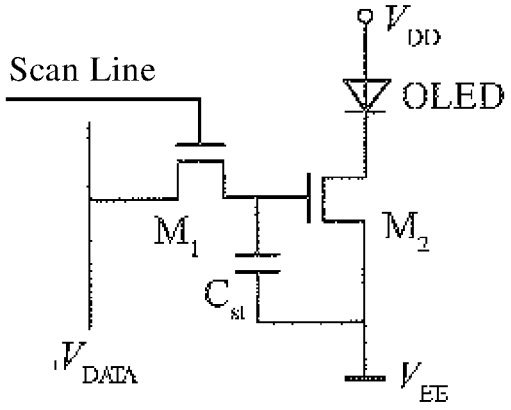
Figure 8A:
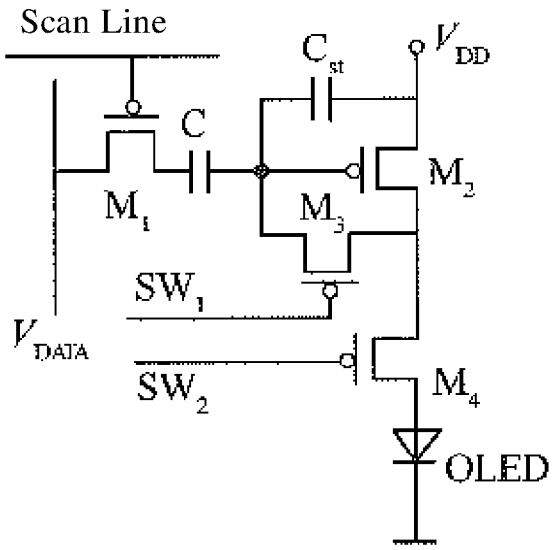
FIG. 8(*a*) and FIG. 8(*b*) respectively illustrate a 4T2C pixel circuit and a 4T1C pixel circuit.
Figure 8B:
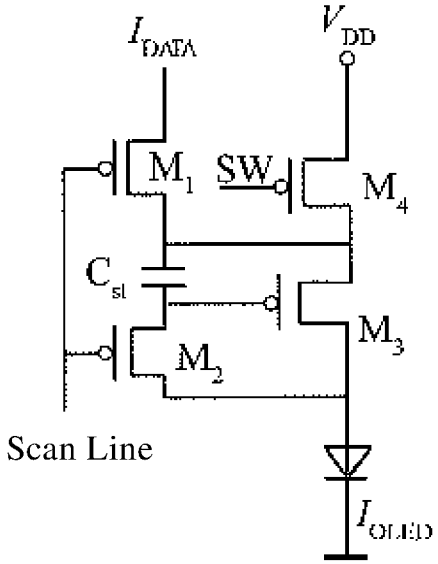

Generally, an OLED display can be actively driven and includes plural sub-pixels arranged in an array. The most typical basic pixel circuit for each of the sub-pixels is of a 2T1C mode (i.e., the pixel circuit includes two transistors (a scanning transistor and a driving transistor) and one storage capacitor). For example, FIG. 7(*a*) and FIG. 7(*b*) illustrate two types of 2T1C pixel circuits, respectively. In order to improve the display uniformity of the entire panel, a pixel circuit having compensating function may be achieved for each of the sub-pixels on the basis of the above-mentioned 2T1C mode. Such kind of pixel circuit may be referred to as a compensation pixel circuit. According to the principle of compensation, the compensation pixel circuit may be classified into three types: voltage compensation, current compensation and hybrid compensation; in this way, various compensation pixel circuits such as 4T2C or 4T1C pixel circuit may be obtained, as illustrated in FIG. 8(*a*) and FIG. 8(*b*). However, as compared to the case of adopting a basic 2T1C pixel circuit, an OLED display panel utilizing the compensation pixel circuit is capable of achieving better uniformity in brightness but may increase the area occupied by the driving circuit portion of each of the sub-pixels on the panel, which may go against the trend for an OLED display panel with higher resolution.

Embodiments of the present disclosure provide a pixel circuit, a display panel, a display device and a driving method, which adopt a solution where plural sub-pixels (e.g., sub-pixels of three colors of red, green and blue) share at least part of a compensation pixel circuit and are driven in a field sequential manner to perform a time-sharing display in a time period of a single frame; that is to say, the plurality of light-emitting sub-circuits are driven respectively in a time-sharing manner by using a single compensation driving circuit. Such arrangement reduces the amount of compensation driving circuits and decreases the area of compensation driving circuits occupied on the panel, and hence facilitates increasing the physical resolution of the display panel.

Figure 1A:
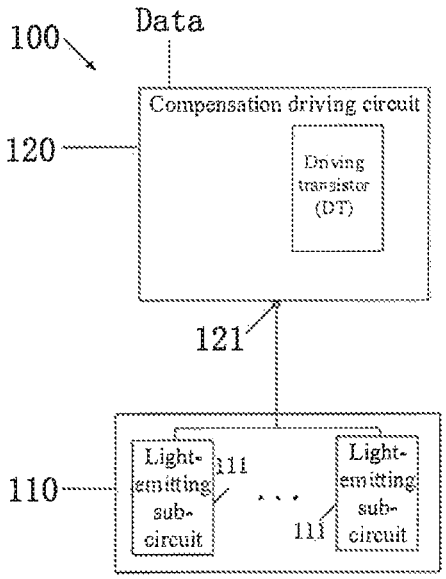
FIG. 1(*a*) and FIG. 1(*b*) are schematic diagrams of a pixel circuit provided by an embodiment of the present disclosure.
Figure 1B:
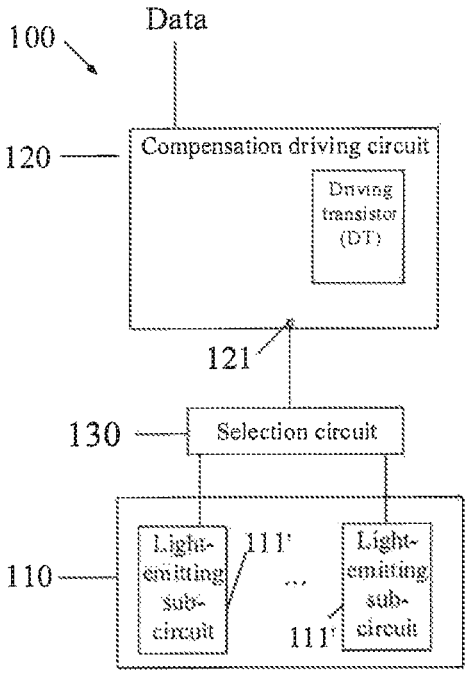

For example, FIG. 1(*a*) is a schematic diagram of a pixel circuit provided by an embodiment of the present disclosure. The embodiment of the present disclosure provides a pixel circuit 100, as illustrated in FIG. 1(*a*), the pixel circuit 100 includes a light-emitting circuit 110 and a compensation driving circuit 120. The light-emitting circuit 110 includes a plurality of light-emitting sub-circuits 111; the compensation driving circuit 120 includes an output terminal 121 and a driving transistor DT. The plurality of light-emitting sub-circuits 111 are all electrically connected to the output terminal 121; and the compensation driving circuit 120 is configured to receive a light-emitting data signal Data, compensate for the threshold voltage of the driving transistor DT, and drive any one of the light-emitting sub-circuits 111 to emit light according to an output signal output by the output terminal 121. Each of the light-emitting sub-circuits may be corresponding to one of sub-pixels, and can electrically connect any one of the plurality of light-emitting sub-circuits 111 and the compensation driving circuit 120 according to a preset signal.

For example, FIG. 1(*b*) is a schematic diagram of another pixel circuit provided by an embodiment of the present disclosure. The embodiment of the present disclosure provides a pixel circuit 100, as illustrated in FIG. 1(*b*), the pixel circuit 100 includes a light-emitting circuit 110, a compensation driving circuit 120 and a selection circuit 130. The light-emitting circuit 110 includes a plurality of light-emitting sub-circuits 111'; the compensation driving circuit 120 includes an output terminal 121 and a driving transistor DT.

The selection circuit 130 is connected to the output terminal 121. The plurality of light-emitting sub-circuits 111' are electrically connected to the selection circuit 130, respectively; and the compensation driving circuit 120 is configured to receive a light-emitting data signal Data, compensate for the threshold voltage of the driving transistor DT, and drive any one of the light-emitting sub-circuits 111' to emit light through the selection circuit 130 according to an output signal output by the output terminal 121. Each of the light-emitting sub-circuits may be corresponding to one of sub-pixels. The selection circuit 130 may electrically connect any one of the plurality of light-emitting sub-circuits 111' and the compensation driving circuit 120 according to a preset signal.

For example, the plurality of light-emitting sub-circuits 111 are connected together, and electrically connected to the output terminal 121.

Figure 2:
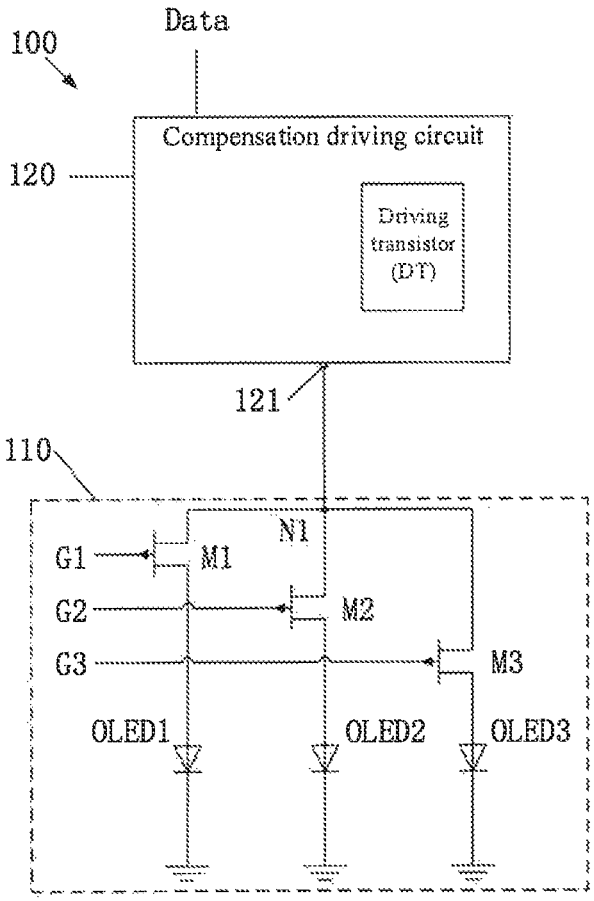
FIG. 2 is a schematic diagram of a pixel circuit provided by an embodiment of the present disclosure.

For example, FIG. 2 is a schematic diagram of a pixel circuit provided by an embodiment of the present disclosure. For example, as illustrated in FIG. 2, in a pixel circuit 100 provided by the embodiment of the present disclosure, each of the light-emitting sub-circuits 111 in the light-emitting circuit 110 includes a switch element and a light-emitting element which are connected in series. The switch element may connect the light-emitting sub-circuit 111 in which the switch element is included and the compensation driving circuit 120 according to a preset signal. Alternatively, three switch elements may be arranged together to constitute the selection circuit 130 as illustrated in FIG. 1(*b*), which are electrically connected to the light-emitting elements of the corresponding light-emitting sub-circuits 111' (herein, the light-emitting sub-circuit 111' may not include a switch element) to drive these light-emitting elements, respectively.

For example, in the pixel circuit 100 provided by the embodiment of the present disclosure, the switch element includes a transistor, and the light-emitting element includes an organic light-emitting diode (OLED).

For example, as illustrated in FIG. 2, in the pixel circuit 100 provided by the embodiment of the present disclosure, the light-emitting circuit 110 includes a first light-emitting sub-circuit, a second light-emitting sub-circuit and a third light-emitting sub-circuit. For example, the first light-emitting sub-circuit, the second light-emitting sub-circuit and the third light-emitting sub-circuit are connected in parallel. The first light-emitting sub-circuit includes a first switch transistor M1 and a first organic light-emitting diode OLED1 which are connected in series; the second light-emitting sub-circuit includes a second switch transistor M2 and a second organic light-emitting diode OLED2 which are connected in series; and the third light-emitting sub-circuit includes a third switch transistor M3 and a third organic light-emitting diode OLED3 which are connected in series.

It should be explained herein that, the light-emitting circuit 110 is merely illustrated in FIG. 2 by way of example, and the light-emitting circuit 110 may include two, four or other number of light-emitting sub-circuits. The structure of the light-emitting sub-circuit is not limited to that illustrated in FIG. 3 either.

For example, the first organic light-emitting diode OLED1 is a red organic light-emitting diode, the second light-emitting diode OLED2 is a green organic light-emitting diode, and the third light-emitting diode OLED3 is a blue organic light-emitting diode. Herein, the three light-emitting sub-circuits are corresponding to RGB sub-pixies, respectively; that is, RGB sub-pixels constitute a single pixel. Obviously, embodiments of the present disclosure are not limited thereto. For example, a single pixel may include a sub-pixel which emits white light (i.e., W), and may also include a sub-pixel which emits yellow light (i.e., Y) so as to achieve RGBW layout or RGBY layout.

For example, as illustrated in FIG. 2, in the pixel circuit 100 provided by the embodiment of the present disclosure, a first electrode of the first switch transistor M1, a first electrode of the second switch transistor M2, and a first electrode of the third switch transistor M3 are all electrically connected to a first node N1. A gate electrode of the first switch transistor M1 is electrically connected to a first gate signal line to receive a first gate signal G1; a gate electrode of the second switch transistor M2 is electrically connected to a second gate signal line to receive a second gate signal G2; and a gate electrode of the third switch transistor M3 is electrically connected to a third gate signal line to receive a third gate signal G3. A second electrode of the first switch transistor M1 is electrically connected to a first electrode (e.g., anode) of the first organic light-emitting diode OLED1; a second electrode of the second switch transistor M2 is electrically connected to a first electrode (e.g., anode) of the second organic light-emitting diode OLED2; and a second electrode of the third switch transistor M3 is electrically connected to a first electrode (e.g., anode) of the third organic light-emitting diode OLED3. A second electrode (e.g., cathode) of the first organic light-emitting diode OLED1, a second electrode (e.g., cathode) of the second organic light-emitting diode OLED2 and a second electrode (e.g., cathode) of the third organic light-emitting diode OLED3 are all grounded.

Figure 3:
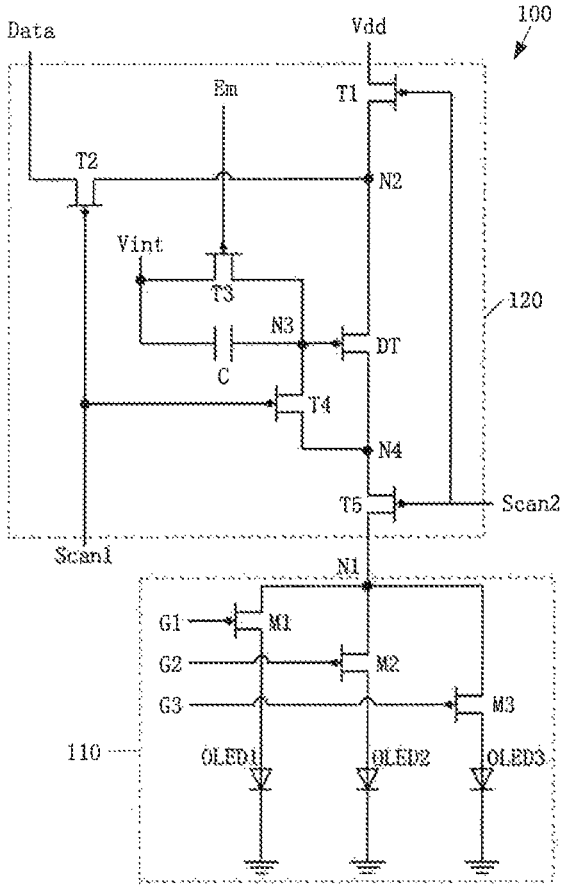
FIG. 3 is a schematic diagram of a pixel circuit provided by an embodiment of the present disclosure.

For example, FIG. 3 is a schematic diagram of a pixel circuit provided by an embodiment of the present disclosure. As illustrated in FIG. 3, in a pixel circuit 100 provided by the embodiment of the present disclosure, the compensation driving circuit 120 further includes a first compensation transistor T1, a second compensation transistor T2, a third compensation transistor T3, a fourth compensation transistor T4, a fifth compensation transistor T5 and a storage capacitor C. The pixel circuit has a compensating function, and is in a 6T1C mode. Obviously, embodiments of the present disclosure are not limited to the particular compensation pixel circuit ilustrated in the the drawings, but may be similarly implemented in other types of compensation pixel circuits, for example. Hereinafter, description will be given with reference to the 6T1C mode as illustrated in FIG. 3 by way of example.

For example, the first compensation transistor T1 is configured to supply the driving transistor DT with a first power supply voltage Vdd in response to a second scanning signal Scan2; the second compensation transistor T2 is configured to supply the driving transistor DT with the light-emitting data signal Data in response to a first scanning signal Scan1; the third compensation transistor T3 is configured to supply the driving transistor DT with a second power supply voltage Vint in response to a controlling signal Em; the fourth compensation transistor T4 is configured to connect a gate electrode and a second electrode of the driving transistor DT in response to the first scanning signal Scan1; the fifth compensation transistor T5 is configured to connect the second electrode of the driving transistor DT and the light-emitting circuit 110 in response to the second scanning signal Scan2; and the storage capacitor C is configured to store a voltage difference between a first electrode and a second electrode of the third compensation transistor T3.

For example, in the pixel circuit 100 provided by the embodiment of the present disclosure, a first electrode of the first compensation transistor T1 is electrically connected to a first power supply line to receive the first power supply voltage Vdd; a gate electrode of the first compensation transistor T1 and a gate electrode of the fifth compensation transistor T5 are electrically connected to a second scanning line to receive the second scanning siginal Scan2; and a second electrode of the first compensation transistor T1 is electrically connected to a second node N2. A first electrode of the second compensation transistor T2 is electrically connected to a light-emitting data signal line to receive the light-emitting data signal Data; a gate electrode of the second compensation transistor T2 and a gate electrode of the fourth compensation transistor T4 are electrically connected to a first scanning line to receive the first scanning siginal Scan1; a second electrode of the second compensation transistor T2 is electrically connected to the second node N2. A first electrode of the third compensation transistor T3 is electrically connected to a second power supply line to receive the second power supply voltage Vint; a gate electrode of the third compensation transistor T3 is electrically connected to a controlling siginal line to receive the controlling siginal Em; a second electrode of the third compensation transistor T3 is electrically connected to a third node N3. A first electrode of the fourth compensation transistor T4 is electrically connected to the third node N3; a second electrode of the fourth compensation transistor T4 is electrically connected to a fourth node N4. A first electrode of the fifth compensation transistor T5 is electrically connected to the fourth node N4; a second electrode of the fifth compensation transistor T5 is electrically connected to the first node N1, that is, the second electrode of the fifth compensation transistor T5 is used as an output terminal of the compensation driving circuit 120 and electrically connected to the plurality of light-emitting sub-circuits. A first electrode of the driving transistor DT is electrically connected to the second node N2; a gate electrode of the driving transistor DT is electrically connected to the third node N3; a second electrode of the driving transistor DT is electrically connected to the fourth node N4. A first end of the storage capacitor C is electrically connected to the second power supply line to receive the second power supply voltage Vint; a second end of the storage capacitor C is electrically connected to the third node N3.

As above described, the compensation driving circuit 120 is merely illustrated in FIG. 3 by way of example, the embodiments of the present disclosure are not limited thereto but may be other compensation driving circuits having functions of compensating for the threshold voltage of the driving transistor DT and driving the light-emitting sub-circuits to emit light according to the output signal output by the output terminal.

For example, in the pixel circuit 100 provided by the embodiment of the present disclosure, the second power supply line is grounded, that is, the second power supply voltage Vint is a ground voltage (e.g., 0V).

It should be explained herein that, the embodiments of the present disclosure are not limited to the case where the second power supply voltage Vint is a ground voltage. The second power supply voltage may also be a stable low voltage, e.g., 1V.

For example, in the pixel circuit 100 provided by the embodiment of the present disclosure, the first switch transistor M1, the second switch transistor M2, the third switch transistor M3, the first compensation transistor T1, the second compensation transistor T2, the third compensation transistor T3, the fourth compensation transistor T4 and the fifth compensation transistor T5 are P-type transistors. For example, with the transistors being all of a same type, the manufacturing process may be unified to facilitate the production.

For example, in the pixel circuit 100 provided by the embodiment of the present disclosure, the first switch transistor M1, the second switch transistor M2, the third switch transistor M3, the first compensation transistor T1, the second compensation transistor T2, the third compensation transistor T3, the fourth compensation transistor T4 and the fifth compensation transistor T5 are all thin film transistors (TFTs).

It should be explained that, all the transistors as used in the embodiments of the present disclosure may be TFTs or field effect transistors (FETs) or other switch elements with similar characteristics. As used herein, a source electrode and a drain electrode of a transistor may be structurally symmetric and hence have no distinction in structure. In the embodiments of the present disclosure, one of the electrodes except the gate electrode of the transistor is directly described as a first electrode while the other one is described as a second electrode for the purpose of distinguishing; therefore the first electrode and the second electrode of part or all of the transistors in the embodiments of the present disclosure may be exchangeable according to actual demands. For example, the first electrode of a transistor described in the embodiments of the present disclosure may be a source electrode while the second electrode may be a drain electrode; alternatively, the first electrode may be a drain electrode while the second electrode may be a source electrode. Moreover, transistors may be classified as N-type transistors and P-type transistors according to characteristics thereof. The embodiments of the present disclosure are described with reference to the case where the first switch transistor M1, the second switch transistor M2, the third switch transistor M3, the first compensation transistor T1, the second compensation transistor T1, the third compensation transistor T3, the fourth compensation transistor T4, and the fifth compensation transistor T5 are all P-type transistors, by way of example. From the description and techncial teachings in terms of the the implementations in the present disclosure, thosed skilled in the art may easily conceive other implementations which adopt N-type transistors or a combination of N-type transistors and P-type transistors in the embodiments of the present disclosure without any inventive work. Therefore, these implementations shall also be fallen within the scope of protection of the present disclosure.

Figure 4:
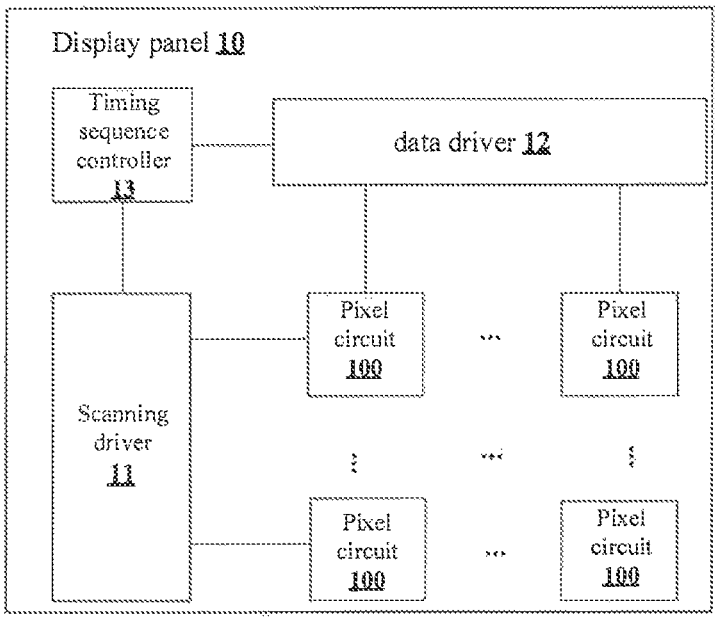
FIG. 4 is a schematic diagram of a display panel provided by an embodiment of the present disclosure.

For example, FIG. 4 is a schematic diagram of a display panel provided by an embodiment of the present disclosure. The embodiment of the present disclosure further provides a display panel 10, as illustrated in FIG. 4, the display panel 10 includes the pixel circuit 100 provided by any one of the embodiments of the present disclosure.

For example, as illustrated FIG. 4, the display panel 10 includes multiple pixel circuits 100.

For example, the display panel 10 includes multiple pixel regions each including sub-pixel regions. The light-emitting circuits in the pixel circuit 100 are arranged in one-to-one correspondence with the pixel regions, and the light-emitting sub-circuits in the light-emitting circuit are arranged in one-to-one correspondence with the sub-pixel regions.

The display panel 10 provided by the embodiment of the present disclosure further includes a scanning driver 11, a data driver 12, a timing sequence controller 13, a light-emitting data signal line, a first gate signal line, a second gate signal line, and a third gate signal line (the light-emitting data signal line, the first gate signal line, the second gate signal line, and the third gate signal line are not illustrated in FIG. 4). The data driver 12 is configured to supply the pixel circuit 100 with a light-emitting data signal through the light-emitting data signal line; the scanning driver 11 is configured to supply the pixel circuit 100 with a first gate signal G1, a second gate signal G2 and a third gate signal G3 through the first gate signal line, the second gate signal line and the third gate signal line, respectively. The timing sequence controller 13 is configured to supply the system with a clock signal so as to coordinate the operations of the system.

For example, the display panel 10 further includes a first scanning signal line, a second scanning signal line and a controlling signal line. The scanning driver is further configured to supply the pixel circuit 100 with a first scanning signal Scan1, a second scanning signal Scan2 and a controlling signal Em through the first scanning signal line, the second scanning signal line and the controlling line, respectively.

Figure 5:
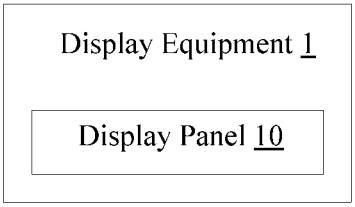
FIG. 5 is a schematic diagram of a display device provided by an embodiment of the present disclosure.

For example, FIG. 5 is a schematic diagram illustrating a display device provided by an embodiment of the present disclosure. The embodiment of the present disclosure further provides a display device 1, as illustrated in FIG. 5, the display device 1 includes the display panel 10 provided by any one of the embodiments of the present disclosure.

For example, the display devices provided by the embodiments of the present disclosure may be any product or component having displaying functions such as mobile phone, tablet PC, television set, displayer, notebook PC, digital photo frame, navigator and the like.

An embodiment of the present disclosure further provides a driving method of the pixel circuit 100 provided by any one of the embodiments of the present disclosure. The driving method includes: in a time period of a single frame including a plurality of time intervals, driving one of the light-emitting sub-circuits in each of the time intervals. That is to say, the plurality of light-emitting sub-circuits are driven in a time-sharing manner to emit light in time periods of a single frame.

Figure 6:
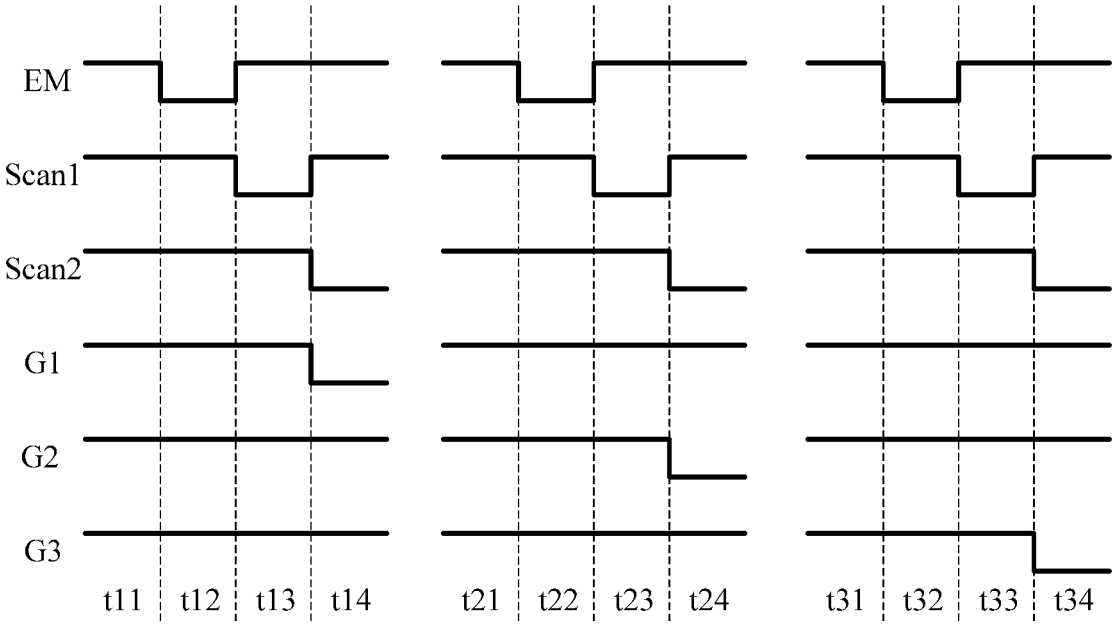
FIG. 6 is a driving waveform diagram of a driving method provided by an embodiment of the present disclosure.

For example, FIG. 6 is a driving waveform diagram of a driving method provided by the embodiment of the present disclosure. The embodiments of the present disclosure further provide a driving method of the pixel circuit 100 provided by any embodiment of the present disclosure. The driving method includes: a single frame time including a first time interval, a second time interval and a third time interval. The first time interval includes a first reset time interval t12, a first compensation time interval t13 and a first light-emitting time interval t14; the second time interval includes a second reset time interval t22, a second compensation time interval t23 and a second light-emitting time interval t24; the third time interval includes a third reset time interval t32, a third compensation time interval t33 and a third light-emitting time interval t34; in the first light-emitting time interval t14, driving the first organic light-emitting diode OLED1 to emit light; in the second light-emitting time interval t24, driving the second organic light-emitting diode OLED2 to emit light; and in the third light-emitting time interval t34, driving the third organic light-emitting diode OLED3 to emit light.

For example, in the driving method provided by any one of the embodiments of the present disclosure, the first time interval further includes a first preparing time interval t11 prior to the first reset time interval t12; the second time interval further includes a second preparing time interval t21 prior to the second reset time interval t22; and the third time interval further includes a third preparing time interval t31 prior to the third reset time interval t32.

For example, as illustrated in FIG. 6, in the driving method provided by an embodiment of the present disclosure, the driving signal is configured as below.

For example, in the embodiments of the present disclosure, a turn-on voltage refers to a voltage allowing a first electrode and a second electrode of respective transistors to be turned on; and a turn-off voltage refers to a voltage allowing the first electrode and the second electrode of respective transistors to be tuned off. When the transistor is a P-type transistor, the on-voltage is a low voltage (e.g., 0V) and the off-voltage is a high voltage (e.g., 5V); when the transistor is a N-type transistor, the on-voltage is a high voltage (e.g., 5V) and the off-voltage is a low voltage (e.g., 0V). The driving waveforms illustrated in FIG. 6 are all drawn with reference to a P-type transistor by way of example; that is, the on-voltage is a low voltage (e.g., 0V) and the off-voltage is a high voltage (e.g., 5V).

For example, in the first time interval: in the first preparing time interval t11, the controlling signal Em is set to be a turn-off voltage, the first scanning signal Scan1 is set to be a turn-off voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the first reset time interval t12, the controlling signal Em is set to be a turn-on voltage, the first scanning signal Scan1 is set to be a turn-off voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the first compensation time interval t13, the controlling signal Em is set to be a turn-off voltage, the first scanning signal Scan1 is set to be a turn-on voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the first light-emitting time interval t14, the controlling signal Em is set to be a turn-off voltage, the first scanning signal Scan1 is set to be a turn-off voltage, the second scanning signal Scan2 is set to be a turn-on voltage, the first gate signal G1 is set to be a turn-on voltage, the second gate signal G2 is set to be a turn-off voltage, and the third gate signal G3 is set to be a turn-off voltage.

For example, in the second time interval: in the second preparing time interval t21, the controlling signal Em is set to be a turn-off voltage, the first scanning signal Scan1 is set to be a turn-off voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the second reset time interval t22, the controlling signal Em is set to be a turn-on voltage, the first scanning signal Scan1 is set to be a turn-off voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the second compensation time interval t23, the controlling signal Em is set to be a turn-off voltage, the first scanning signal Scan1 is set to be a turn-on voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the second light-emitting time interval t24, the controlling signal Em is set to be a turn-off voltage, the first scanning signal Scan1 is set to be a turn-off voltage, the second scanning signal Scan2 is set to be a turn-on voltage, the first gate signal G1 is set to be a turn-off voltage, the second gate signal G2 is set to be a turn-on voltage, and the third gate signal G3 is set to be a turn-off voltage.

For example, in the third time interval: in the third preparing time interval t31, the controlling signal Em is set to be a turn-off voltage, the first scanning signal Scan1 is set to be a turn-off voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the third reset time interval t32, the controlling signal Em is set to be a turn-on voltage, the first scanning signal Scan1 is set to be a turn-off voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; in the third compensation time interval t33, the controlling signal Em is set to be a turn-off voltage, the first scanning signal Scan1 is set to be a turn-on voltage, the second scanning signal Scan2 is set to be a turn-off voltage, the first gate signal G1 is set to be a turn-off voltage, the second gate signal G2 is set to be a turn-off voltage, and the third gate signal G3 is set to be a turn-off voltage; and in the third light-emitting time interval t34, the controlling signal Em is set to be a turn-off voltage, the first scanning signal Scan1 is set to be a turn-off voltage, the second scanning signal Scan2 is set to be a turn-on voltage, the first gate signal G1 is set to be a turn-off voltage, the second gate signal G2 is set to be a turn-off voltage, and the third gate signal G3 is set to be a turn-on voltage.

For example, hereinafter a working flow of the pixel circuit will be described with reference to FIG. 3 and FIG. 6. Taking the first time interval as an example, in the first preparing time interval t11, the controlling signal Em is a turn-off voltage, the first scanning signal Scan1 is a turn-off voltage, the second scanning signal Scan2 is a turn-off voltage, the first gate signal G1 is a turn-off voltage, the second gate signal G2 is a turn-off voltage, and the third gate signal G3 is a turn-off voltage. As a result, the first switch transistor M1, the second switch transistor M2, the third switch transistor M3, the first compensation transistor T1, the second compensation transistor T2, the third compensation transistor T3, the fourth compensation transistor T4, and the fifth compensation transistor T5 are all in a turned-off state. The first preparing time interval can provide a stable process for the pixel circuit, so as to prevent from circuit failures due to influences such as inadequate discharge of parasitic capacitor.

In the first reset time interval t12, the controlling signal Em is a turn-on voltage, the first scanning signal Scan1 is a turn-off voltage, the second scanning signal Scan2 is a turn-off voltage, the first gate signal G1 is a turn-off voltage, the second gate signal G2 is a turn-off voltage, and the third gate signal G3 is a turn-off voltage. As a result, the third compensation transistor T3 is turned on, while the first switch transistor M1, the second switch transistor M2, the third switch transistor M3, the first compensation transistor T1, the second compensation transistor T2, the fourth compensation transistor T4 and the fifth compensation transistor T5 are all in a turned-off state. A voltage across both ends of the storage capacitor C is initialized as a second power supply voltage Vint (e.g., the second power supply voltage may be a stable low voltage or a ground voltage) to achieve initialization of the pixel circuit.

In the first compensation time interval t13, the controlling signal Em is a turn-off voltage, the first scanning signal Scan1 is a turn-on voltage, the second scanning signal Scan2 is a turn-off voltage, the first gate signal G1 is a turn-off voltage, the second gate signal G2 is a turn-off voltage, and the third gate signal G3 is a turn-off voltage. As a result, the second compensation transistor T2 and the fourth compensation transistor T4 are turned on, while the first switch transistor M1, the second switch transistor M2, the third switch transistor M3, the first compensation transistor T1, the third compensation transistor T3 and the fifth compensation transistor T5 are all in a turned-off state. The third node N3 is charged with the light-emitting data signal Data through the second compensation transistor T2, the driving transistor DT and the fourth compensation transistor T4 until the voltage of the third node N3 reaches Vdata+Vth, wherein Vdata is the voltage of the light-emitting data signal Data, Vth is the threshold voltage of the driving transistor DT, and therefore an adequate voltage difference between the gate electrode and the source electrode of the driving transistor DT is Vth. Upon completing charging, the voltage difference across both ends of the storage capacitor C will be Vdata+Vth. Moreover, because the fifth compensation transistor T5 is in a turned off state, the current does not flow through the OLED, which prevents the OLED from emitting light in this time interval, and hence improves the displaying effect and reduces the loss of the OLED.

In the first light-emitting time interval t14, the controlling signal Em is a turn-off voltage, the first scanning signal Scan1 is a turn-off voltage, the second scanning signal Scan2 is a turn-on voltage, the first gate signal G1 is a turn-on voltage, the second gate signal G2 is a turn-off voltage, and the third gate signal G3 is a turn-off voltage. As a result, the first switch transistor M1, the first compensation transistor T1 and the fifth compensation transistor T5 are turned on, while the second switch transistor M2, the third switch transistor M3, the second compensation transistor T2, the third compensation transistor T3 and the fourth compensation transistor T4 are all in a turned-off state. In the first light-emitting time interval, because of the effect of the storage capacitor C, the voltage of the third node N3 is maintained at Vdata+Vth; the light-emitting current IOLED flows through the first compensation transistor T1, the driving transistor DT, the fifth compensation transistor T5, the first switch transistor M1 and the first organic light-emitting diode OLED1; and then the first organic light-emitting diode OLED1 emits light. The light-emitting current IOLED satisfies a saturation current formula as below:

$$\begin{aligned} IOLED &= K(VGS - Vth)^2 \\ &= K(Vdata + Vth - Vdd - Vth)^2 \\ &= K(Vdata - Vdd)^2. \end{aligned}$$

In the formula, $$K = 0.5\ \mu_n Cox \frac{W}{L};$$

$\mu_n$ represents the channel mobility of the driving transistor; Cox represents the channel capacitance per unit area of the driving transistor; W and L represent the channel width and the channel length of the driving transistor, respectively; VGS represents the gate-source voltage of the driving transistor (i.e., the difference between a gate voltage and a source voltage of the driving transistor).

As it can be seen from the formula above, the light-emitting current IOLED is no longer affected by the threshold value Vth of the driving transistor but only related to the voltage Vdata of the light-emitting data signal and the first power supply voltage Vdd. In this way, the problem of threshold voltage shift in the driving transistor can be solved, and a normal operation of the OLED display panel can be ensured.

For example, the working flow of the second organic light-emitting diode OLED2 in the second time interval and the working flow of the third organic light-emitting diode OLED3 in the third time interval are similar with those in the first time interval, and hence the details will be omitted herein.

It should be explained that, an embodiment of the present disclosure further provides a driving method of the pixel circuit provided by any embodiment of the present disclosure, including but not limited to the situations listed as above. For example, the light-emitting circuit further includes a fourth light-emitting sub-circuit, and the fourth light-emitting sub-circuit includes a fourth organic light-emitting diode; a single frame time may further include a fourth time interval. In the fourth time interval, the fourth organic light-emitting diode OLED4 is driven to emit light.

Embodiments of the present disclosure provide a pixel circuit, a display panel, a display device and a driving method, which adopt a solution where plural sub-pixels (e.g., sub-pixels of three colors of red, green and blue) share at least part of a compensation pixel circuit and are driven in a field sequential manner to perform a time-sharing display in a time period of a single frame; that is to say, the plurality of light-emitting sub-circuits are driven respectively in a time-sharing manner by using a single compensation driving circuit. Such an arrangement reduces an amount of the compensation driving circuit and decreases the area of the compensation driving circuit occupied on the backboard, and hence facilitates increasing the physical resolution of the display panel.

Obviously, various modifications and deformations can be made to the present disclosure by those skilled in the art without departing from the spirit and scope of the present disclosure. Therefore, the present disclosure is intended to include the modifications and deformations fallen within the scope of the appended claims and equivalents thereof.

The present application claims the benefits of Chinese patent application No. 201610663613.2 filed on Aug. 12, 2016, which is incorporated herein by reference as part of the application.

What is claimed is:

1. A driving method of a pixel circuit, the pixel circuit comprising:

a light-emitting circuit comprising a plurality of light-emitting sub-circuits; and a compensation driving circuit comprising an output terminal and a driving transistor; wherein the plurality of light-emitting sub-circuits are all electrically connected to the output terminal; and the compensation driving circuit is configured to receive a light-emitting data signal, compensate for a threshold voltage of the driving transistor, and drive any one of the plurality of light-emitting sub-circuits to emit light according to an output signal output by the output terminal, wherein, the light-emitting circuit comprises a first light-emitting sub-circuit, a second light-emitting sub-circuit and a third light-emitting sub-circuit, and the first light-emitting sub-circuit comprises a first switch transistor and a first OLED which are connected in series, the second light-emitting sub-circuit comprises a second switch transistor and a second OLED which are connected in series; and the third light-emitting sub-circuit comprises a third switch transistor and a third OLED which are connected in series, wherein a first electrode of the first switch transistor, a first electrode of the second switch transistor, and a first electrode of the third switch transistor are electrically connected to a first node, a gate electrode of the first switch transistor is configured to receive a first gate signal, a gate electrode of the second switch transistor is configured to receive a second gate signal, a gate electrode of the third switch transistor is configured to receive a third gate signal, a second electrode of the first switch transistor is electrically connected to a first electrode of the first OLED, a second electrode of the second switch transistor is electrically connected to a first electrode of the second OLED, a second electrode of the third switch transistor is electrically connected to a first electrode of the third OLED, and a second electrode of the first OLED, a second electrode of the second OLED and a second electrode of the third OLED are all grounded, and wherein the compensation driving circuit further comprises:

a first compensation transistor configured to supply the driving transistor with a first power supply voltage in response to a second scanning signal;

a second compensation transistor configured to supply the driving transistor with the light-emitting data signal in response to a first scanning signal;

a third compensation transistor configured to supply the driving transistor with a second power supply voltage in response to a controlling signal;

a fourth compensation transistor configured to connect a gate electrode and a second electrode of the driving transistor in response to the first scanning signal;

a fifth compensation transistor configured to connect the second electrode of the driving transistor and the light-emitting circuit in response to the second scanning signal; and a storage capacitor configured to store a voltage difference between a first electrode and a second electrode of the third compensation transistor;

wherein the driving method comprises: for a single frame time comprising a first time interval, a second time interval and a third time interval, the first time interval comprises a first reset time interval, a first compensation time interval, a first light-emitting time interval, and a first preparing time interval prior to the first reset time interval;

the second time interval comprises a second reset time interval, a second compensation time interval, a second light-emitting time interval, and a second preparing time interval prior to the second reset time interval;

the third time interval comprises a third reset time interval, a third compensation time interval, a third light-emitting time interval, and a third preparing time interval prior to the third reset time interval;

in the first light-emitting time interval, driving the first OLED to emit light;

in the second light-emitting time interval, driving the second OLED to emit light; and in the third light-emitting time interval, driving the third OLED to emit light.

2. The driving method according to claim 1, comprising:

in the first preparing time interval, setting the controlling signal to be a turn-off voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage;

in the first reset time interval, setting the controlling signal to be a turn-on voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage;

in the first compensation time interval, setting the controlling signal to be a turn-off voltage, setting the first scanning signal to be a turn-on voltage, setting the second scanning signal to be a turn-off voltage, setting the first gate signal to be a turn-off voltage, setting the second gate signal to be a turn-off voltage, and setting the third gate signal to be a turn-off voltage;

in the first light-emitting time interval, setting the controlling signal to be a turn-off voltage, setting the first scanning signal to be a turn-off voltage, setting the second scanning signal to be a turn-on voltage, setting the first gate signal to be a turn-on voltage, setting the second gate signal to be a turn-off voltage, and setting the third gate signal to be a turn-off voltage;

in the second preparing time interval, setting the controlling signal to be a turn-off voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage;

in the second reset time interval, setting the controlling signal to be a turn-on voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be turn-off voltage;

in the second compensation time interval, setting the controlling signal to be a turn-off voltage, setting the first scanning signal to be a turn-on voltage, setting the second scanning signal to be a turn-off voltage, setting the first gate signal to be a turn-off voltage, setting the second gate signal to be a turn-off voltage, and setting the third gate signal to be a turn-off voltage;

in the second light-emitting time interval, setting the controlling signal to be a turn-off voltage, setting the first scanning signal to be a turn-off voltage, setting the second scanning signal to be a turn-on voltage, setting the first gate signal to be a turn-off voltage, setting the second gate signal to be a turn-on voltage, and setting the third gate signal to be a turn-off voltage;

in the third preparing time interval, setting the controlling signal to be a turn-off voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage;

in the third reset time interval, setting the controlling signal to be a turn-on voltage, setting the first scanning signal to be a turn-off voltage, setting the second scanning signal to be a turn-off voltage, setting the first gate signal to be a turn-off voltage, setting the second gate signal to be a turn-off voltage, and setting the third gate signal to be a turn-off voltage;

in the third compensation time interval, setting the controlling signal to be a turn-off voltage, setting the first scanning signal to be a turn-on voltage, setting the second scanning signal to be a turn-off voltage, setting the first gate signal to be a turn-off voltage, setting the second gate signal to be a turn-off voltage, and setting the third gate signal to be a turn-off voltage; and in the third light-emitting time interval, setting the controlling signal to be a turn-off voltage, setting the first scanning signal to be a turn-off voltage, setting the second scanning signal to be a turn-on voltage, setting the first gate signal to be a turn-off voltage, setting the second gate signal to be a turn-off voltage, and setting the third gate signal to be a turn-on voltage.

* * * * *